US008477964B2

(12) United States Patent
Ruwisch

(10) Patent No.: US 8,477,964 B2
(45) Date of Patent: Jul. 2, 2013

(54) METHOD AND DEVICE FOR PHASE-SENSITIVE PROCESSING OF SOUND SIGNALS

(71) Applicant: Dietmar Ruwisch, Berlin (DE)

(72) Inventor: Dietmar Ruwisch, Berlin (DE)

( * ) Notice: Subject to any disclaimer, the term of this patent is extended or adjusted under 35 U.S.C. 154(b) by 0 days.

(21) Appl. No.: 13/691,123

(22) Filed: Nov. 30, 2012

(65) Prior Publication Data

US 2013/0094664 A1 Apr. 18, 2013

Related U.S. Application Data

(63) Continuation of application No. 12/842,454, filed on Jul. 23, 2010, now Pat. No. 8,340,321.

(30) Foreign Application Priority Data

Feb. 15, 2010 (DE) ..... 10 2010 001 935

(51) Int. Cl.
*H04R 1/40* (2006.01)

(52) U.S. Cl.
USPC ..... 381/97; 381/356

(58) Field of Classification Search
USPC ..... 381/97, 356
See application file for complete search history.

(56) References Cited

U.S. PATENT DOCUMENTS

| | | | |
|---|---|---|---|
| 7,327,852 | B2 | 2/2008 | Ruwisch |
| 2011/0200206 | A1 | 8/2011 | Ruwisch |

FOREIGN PATENT DOCUMENTS

| | | | |
|---|---|---|---|
| DE | 102004005998 | B3 | 5/2005 |
| EP | 1 453 348 | A1 | 9/2004 |
| EP | 1 595 427 | A1 | 11/2005 |
| EP | 2 296 356 | A2 | 3/2011 |
| WO | WO 2004/038697 | A1 | 5/2004 |

OTHER PUBLICATIONS

European Search report corresponding to EP 11152903.8 mailed Jun. 7, 2011, 13 pages, (Includes English Translation).

*Primary Examiner* — Ramon Barrera
(74) *Attorney, Agent, or Firm* — Harrity & Harrity, LLP

(57) ABSTRACT

A method and device for phase-sensitive processing of sound signals of at least one sound source may include arranging two microphones at a distance d from each other, capturing sound signals with both microphones, generating associated microphone signals, and processing the sound signals of the microphones. During a calibration mode, a calibration-position-specific, frequency-dependent phase difference vector $\phi 0(f)$ between the associated calibration microphone signals may be calculated from their frequency spectra for the calibration position. Then, during an operating mode, a signal spectrum S of a signal to be output is calculated by multiplication of at least one of the two frequency spectra of the current microphone signals with a spectral filter function F.

20 Claims, 5 Drawing Sheets

Spatial-angle-dependent filter determination

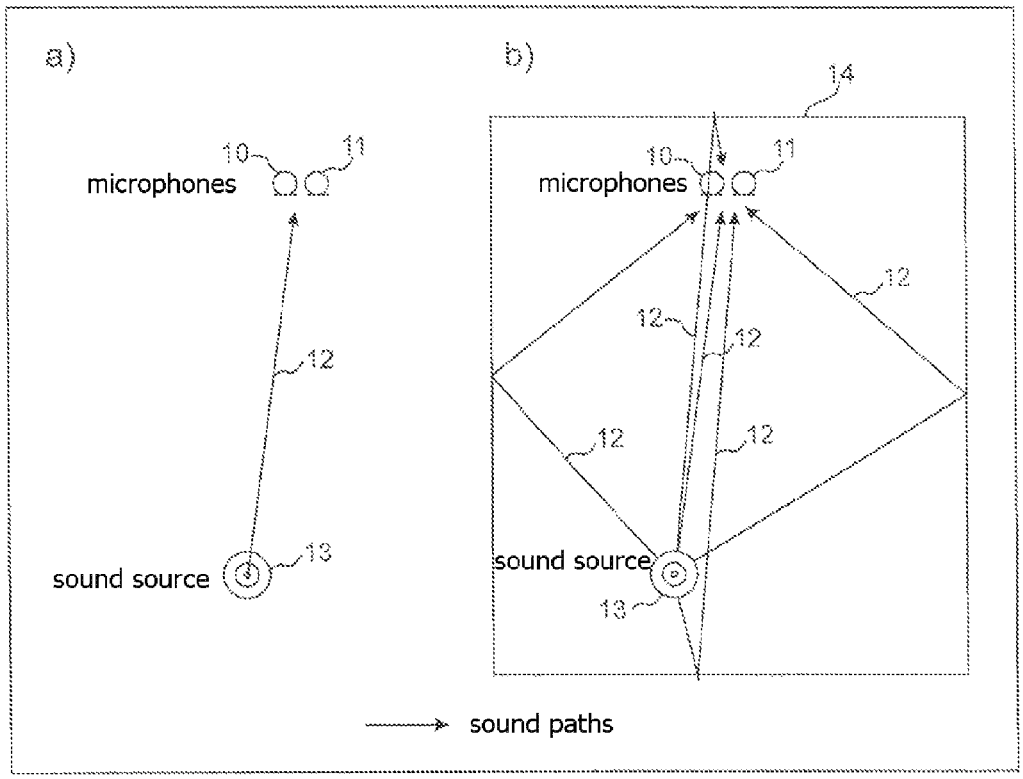
Fig. 1: sound paths in free field (a) and with reflections (b)

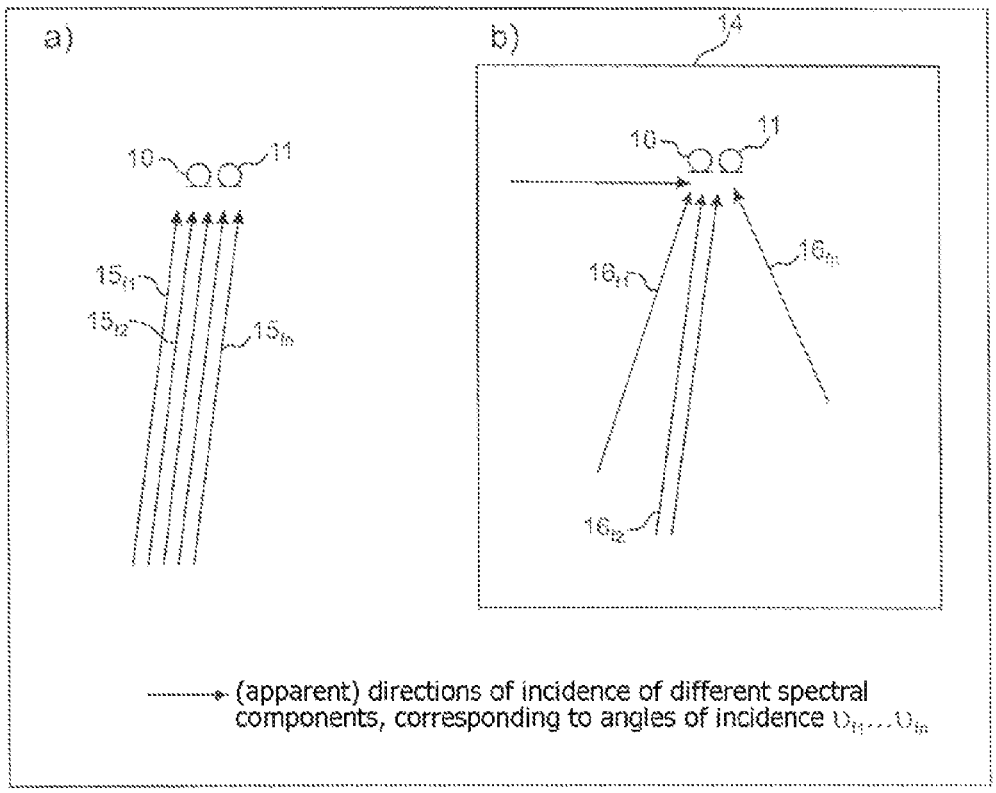
Fig 2: Directions of incidence in free field (a) and with reflections (b)

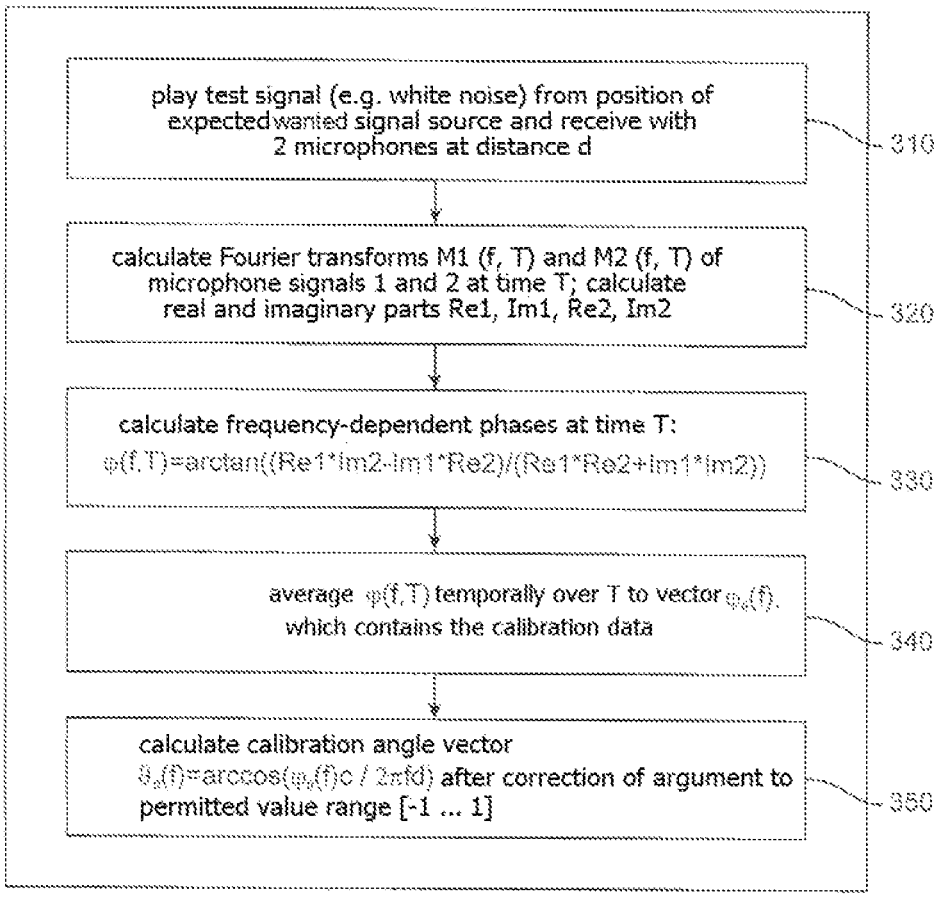
Fig. 3: Determining calibration data

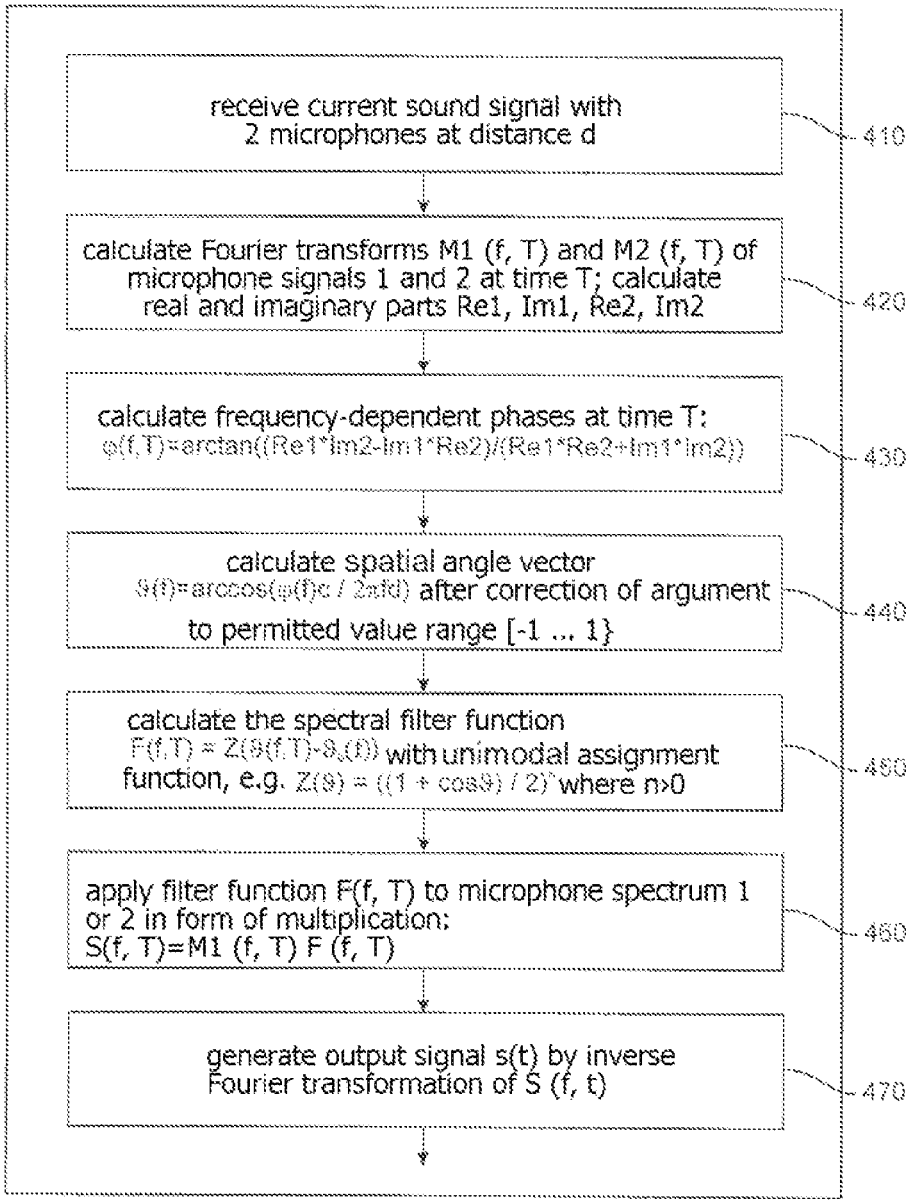
Fig. 4: Spatial-angle-dependent filter determination

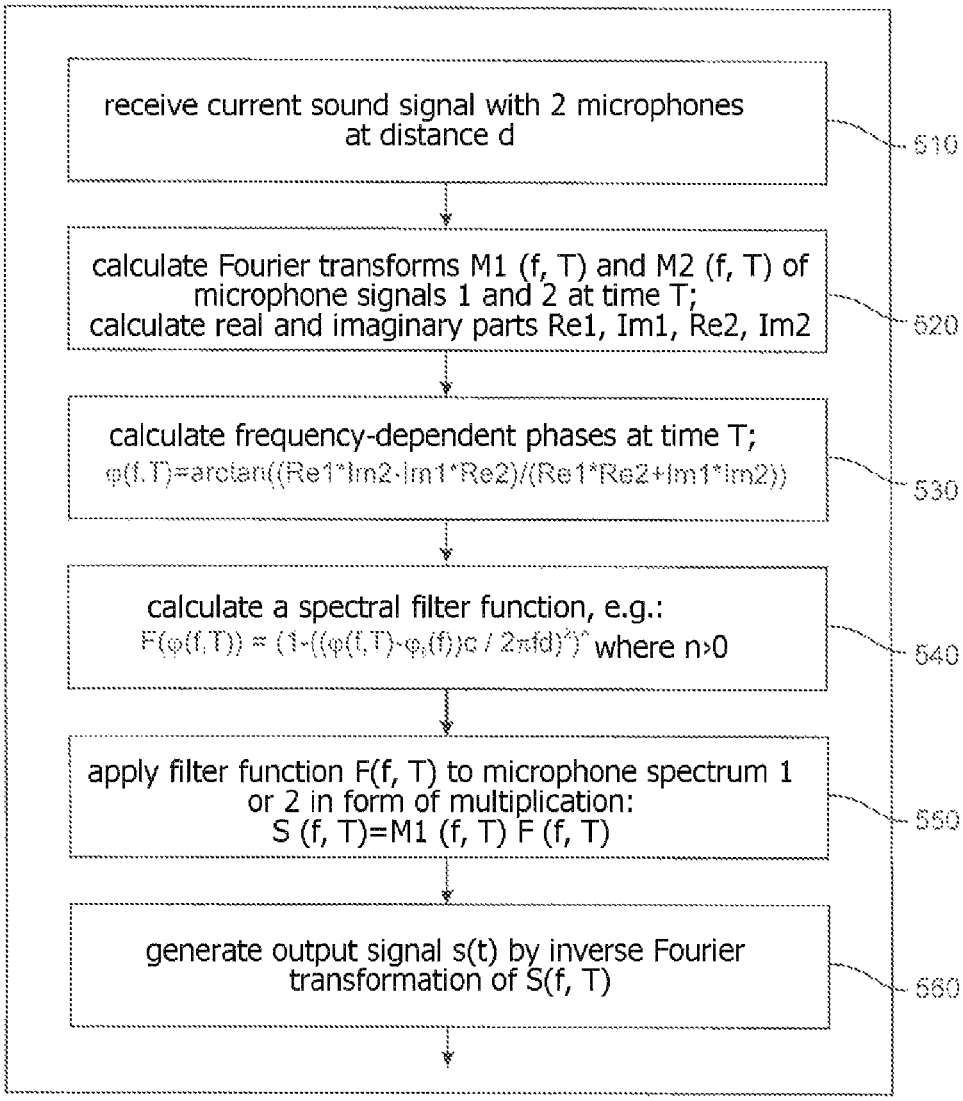
Fig. 5: Phase-angle-dependent filter determination

METHOD AND DEVICE FOR PHASE-SENSITIVE PROCESSING OF SOUND SIGNALS

RELATED APPLICATION

This application is a continuation of U.S. patent application Ser. No. 12/842,454, filed on Jul. 23, 2010, which is based upon and claims the benefit of priority from German Patent Application No. 10 2010 001 935.6, filed on Feb. 15, 2010, the disclosures of which are incorporated herein in their entirety by reference.

TECHNICAL FIELD

This invention generally relates to a method and device for processing sound signals of at least one sound source. The invention is in the field of digital processing of sound signals which are received by a microphone array. The invention particularly relates to a method and a device for phase-sensitive or phase-dependent processing of sound signals which are received by a microphone array.

BACKGROUND ART

The term "microphone array" is used if two or more microphones, at a distance from each other, are used to receive sound signals (multiple-microphone technique). It is thus possible to achieve directional sensitivity in the digital signal processing. The classic "shift and add" and "filter and add" methods, in which a microphone signal is shifted in time relative to the second one or filtered, before the thus manipulated signals are added, should be mentioned first here. In this way, it is possible to achieve sound extinction ("destructive interference") for signals which arrive from a specified direction. Since the underlying wave geometry is formally identical to the generation of a directional effect in radio applications when multiple aerials are used, the term "beam forming" is also used, the "beam" of radio waves being replaced by the attenuation direction in the multiple-microphone technique. The term "beam forming" has become accepted as a generic term for microphone array applications, although actually no "beam" is involved in this case. Misleadingly, the term is not only used for the classic two-microphone or multiple-microphone technique described above, but also for more advanced, non-linear array techniques for which the analogy with the aerial technique no longer applies.

In many applications, the classic method fails to achieve the actually desired aim. Attenuating sound signals which arrive from a specified direction is often little use. What is more desirable is, as far as possible, to pass on or further process only the signals from one (or more) specified signal source(s), such as those from a desired speaker.

From EP 1595427 B1, a method of separating sound signals is known. According to the method described there, the angle and width of the "directional cone" for the desired signals (actually not a cone but a hyperboloid of rotation), and the attenuation for undesired signals outside the directional cone, can be controlled by parameters. The described method calculates a signal-dependent filter function, the spectral filter coefficients being calculated using a specified filter function, the argument of which is the angle of incidence of a spectral signal component. The angle of incidence is determined, using trigonometric functions or their inverse functions, from the phase angle between the two microphone signal components; this calculation also takes place with spectral resolution, i.e. separately for each representable frequency. The angle and width of the directional cone, and the maximum attenuation, are parameters of the filter function.

The method disclosed in EP 1595427 B1 has several disadvantages. The results which can be achieved with the method correspond to the desired aim, of separating sound signals of a specified sound source, only in the free field and near field. Additionally, very small tolerance of the components, in particular the microphones, which are used is necessary, since disturbances in the phases of the microphone signals have a negative effect on the effectiveness of the method. The required narrow component tolerances can be at least partly achieved using suitable production technologies, but these are often associated with higher production costs. The near field and free field restrictions are more difficult to circumvent. The term "free field" is used if the sound wave arrives at the microphones 10, 11 without hindrance, i.e. without being reflected, attenuated, or otherwise changed on the signal path 12 from the sound source 13, as shown in FIG. 1*a*. In the near field, in contrast to the far field, where the sound signal arrives as a plane wave, the curvature of the wave front is shown clearly. Even if this is actually an undesired difference from the geometrical considerations of the method, which are based on plane waves, there is normally great similarity to the free field in one essential point. Because the signal or sound source 13 is so near, the phase disturbances because of reflections or similar are normally small in comparison with the desired signal. FIG. 1*b* shows the use of the microphones 10, 11 and sound source 13 in an enclosed room 14, such as a motor vehicle interior. However, when used in enclosed rooms, the phase effects are considerable, since the result of the reflections of the sound waves on flat or smooth surfaces in particular, e.g. windscreens or side windows, is that the sound waves are propagated on different sound paths 12, and near the microphones disturb the phase relationship between the signals of the two microphones so greatly that the result of the signal processing according to the method described above is unsatisfactory.

The result of the phase disturbances because of reflections, as shown in FIG. 1*b*, is that the spectral components of the sound signal of a sound source 13 apparently strike the microphones 10, 11 from different directions. FIG. 2 shows the directions of incidence in the free field (FIG. 2*a*) and in the case of reflections (FIG. 2*b*), for comparison. In the free field, all spectral components of the sound signal $\mathbf{15}_{f1}$, $\mathbf{15}_{f2}$, . . . , $\mathbf{15}_{fn}$ come from the direction of the sound source (not shown in FIG. 2). According to FIG. 2*b*, the spectral components of the sound signal 16*f*1, 16*f*2, . . . , 16*fn*, because of the frequency-dependent reflections, strike the microphones 10, 11 at quite different apparent angles of incidence $\theta_{f1}$, $\theta_{f2}$, . . . $\theta_{fn}$, although the sound signal was generated by one sound source 13. Processing the sound signals in narrower or enclosed rooms, in which only sound signals from a specified angle of incidence are taken into account, gives unsatisfactory results, since in this way certain spectral components of the sound signal are not or inadequately processed, which in particular results in deterioration in the signal quality.

A further disadvantage of the known method is that the angle of incidence as a geometrical angle must first be calculated from the phase angle between the two microphone signal components, using trigonometric functions or their inverse functions. This calculation is resource-intensive, and the trigonometric function arc cosine (arccos), which is required among others, is defined only in the range [−1, 1], so that in addition a corresponding correction function may be necessary.

SUMMARY

It is therefore the object of the present invention to propose, for processing sound signals, a method and device which as far as possible avoid the disadvantages of the prior art, and in particular make it possible to compensate for phase disturbances or phase effects the signals are affected with. It is also an aim of the invention to propose a method and device for phase-sensitive processing of sound signals, said method and device making it possible to compensate for systematic errors in the microphone signals, e.g. because of component tolerances, and/or to calibrate individual components, e.g. the microphones or the whole device.

According to the invention, for this purpose a method for phase-sensitive processing of sound signals of at least one sound source and a device for phase-sensitive processing of sound signals of at least one sound source are proposed.

The invention further provides a computer program product and a computer-readable storage medium.

Advantageous further embodiments of the invention are defined in the appropriate dependent claims.

The method according to the invention for phase-sensitive processing of sound signals of at least one sound source includes, in principle, the steps of arranging at least two microphones MIK1, MIK2 at a distance d from each other, capturing sound signals with both microphones, generating associated microphone signals, and processing the microphone signals. In a calibration mode, the following steps are carried out: defining at least one calibration position of a sound source, capturing separately the sound signals for the calibration position with both microphones, generating calibration microphone signals associated with the respective microphone for the calibration position, determining the frequency spectra of the associated calibration microphone signals, and calculating a calibration-position-specific, frequency-dependent phase difference vector $\phi 0(f)$ between the associated calibration microphone signals from their frequency spectra for the calibration position. During an operating mode, the following steps are then carried out: capturing the current sound signals with both microphones, generating associated current microphone signals, determining the current frequency spectra of the associated current microphone signals, calculating a current, frequency-dependent phase difference vector $\phi(f)$ between the associated current microphone signals from their frequency spectra, selecting at least one of the defined calibration positions, calculating a spectral filter function F depending on the current, frequency-dependent phase difference vector $\phi(f)$ and the respective calibration-position-specific, frequency-dependent phase difference vector $\phi 0(f)$ of the selected calibration position, generating a signal spectrum S of a signal to be output by multiplication of at least one of the two frequency spectra of the current microphone signals with the spectral filter function F of the respective selected calibration position, the filter function being chosen such that the smaller the absolute value of the difference between current and calibration-position-specific phase difference for the corresponding frequency, the smaller the attenuation of spectral components of sound signals, and obtaining the signal to be output for the relevant selected calibration position by inverse transformation of the generated signal spectrum.

In this way, the method and device according to the invention provide a calibration procedure according to which, for at least one position of the expected desired signal source, as a so-called calibration position, during the calibration mode, sound signals, which for example are generated by playing a test signal, are received by the microphones with their phase effects and phase disturbances. Then, from the received microphone signals, the frequency-dependent phase difference vector $\phi 0(f)$ between these microphone signals is calculated from their frequency spectra for the calibration position. In the subsequent signal processing in operating mode, this frequency-dependent phase difference vector $\phi 0(f)$ is then used to calibrate the filter function for generating the signal spectrum of the signal to be output, so that it is possible to compensate for phase disturbances and phase effects in the sound signals. By the subsequent application of the thus calibrated filter function to at least one of the current microphone signals by multiplication of the spectrum of the current microphone signal with the filter function, a signal spectrum of the signal to be output, essentially containing only signals of the selected calibration position, is generated. The filter function is chosen so that spectral components of sound signals, which according to their phase difference correspond to the calibration microphone signals and thus to the presumed desired signals, are not or are less strongly attenuated than spectral components of sound signals whose phase difference differs from the calibration-position-specific phase difference. Additionally, the filter function is chosen so that the greater the absolute value of the difference between current and calibration-position-specific phase difference for a certain frequency, the stronger the attenuation of the corresponding spectral component of sound signals.

If the calibration is applied not only model-specific, but according to an embodiment to each device, e.g. for each individual microphone array device in its operating environment, in this way it is possible to compensate not only for those phase effects and phase disturbances of the specific device in operation which are typical of the model or depend on constructive constraints, but also for those which are caused by component tolerances and the operating conditions. This embodiment is therefore suitable for compensating, simply and reliably, for component tolerances of the microphones such as their phasing and sensitivity. Even effects which are not caused by changing the spatial position of the desired signal source itself, but by changes in the environment of the desired signal source, e.g. by the side window of a motor vehicle being opened, can be taken into account. In this case the calibration position is defined as a state space position, which includes, for example, the room condition as an additional dimension. If such changes or variations of the calibration position occur during operation, they can in principle not be handled by a one-time calibration. For this purpose, the method according to the invention is then made into an adaptive method, in which the calibration-position-specific, frequency-dependent phase difference vector $\phi 0(f)$ is calculated or updated not merely from microphone signals which are captured once during calibration phase, but also from the microphone signals of the actual desired signals during operation.

According to a further embodiment of the invention, the method and device first work in operating mode. In this case the calibration-position-specific, frequency-dependent phase difference vector $\phi 0(f)$ is set to $\phi 0(f)=0$ for all frequencies f. At a later time, the method and device switch into calibration mode and calculate the calibration-position-specific, frequency-dependent phase difference vector $\phi 0(f)$; for example, a user speaks test signals, which are captured by the microphones, to generate associated calibration microphone signals from them. From the associated calibration microphone signals, the calibration-position-specific, frequency-dependent phase difference vector $\phi 0(f)$ is then calculated. This is followed by a switch back into operating mode, in which the spectral filter functions F are calculated for each current frequency-dependent phase difference vector depending on the respective, previously determined calibration-position-specific, frequency-dependent phase difference vector.

In this way, use without calibration, with standard settings, is possible at first. Then, as soon as a switch into calibration mode takes place, calibration can be achieved not only with respect to the component tolerances, for example, but also to the current operating environment, the specific conditions of use and the user.

In other words, the invention allows, in particular, phase-sensitive and also frequency-dependent processing of sound signals, without it being necessary to determine the angle of incidence of the sound signals, at least one spectral component of the current sound signal being attenuated depending on the difference between their phase difference and a calibration-position-specific phase difference of the corresponding frequency.

BRIEF DESCRIPTION OF THE DRAWINGS

FIG. 1 shows schematically the propagation of sound signals of a sound source in the free field (a) and in the case of reflections in the near field (b);

FIG. 2 shows schematically the apparent directions of incidence of sound signals of a sound source in the free field (a) and in the case of reflections in the near field (b);

FIG. 3 shows a flowchart for determining the calibration data in calibration mode according to one embodiment of the invention;

FIG. 4 shows a flowchart for determining the filter function depending on the spatial angle, according to one embodiment of the invention; and FIG. 5 shows a flowchart for determining the filter function depending on the phase angle, according to one embodiment of the invention.

DETAILED DESCRIPTION

Embodiments of the invention determine, in a calibration procedure for desired sound signals, phase-sensitive calibration data which take account of the application-dependent phase effects, and to use these calibration data subsequently in the signal processing, to compensate for phase disturbances and phase effects.

For example, the method may provide an arrangement of at least two microphones MIK1, MIK2 at a fixed distance d from each other. To avoid ambiguity of phase differences, this distance must be chosen to be less than half the wavelength of the highest occurring frequency, i.e. less than speed of sound divided by sampling rate of the microphone signals. For example, a suitable value of the microphone distance d for speech processing in practice is 1 cm. Then, with each microphone, the sound signals which are generated by a sound source which is arranged in a calibration position are captured separately. Each microphone generates, from the sound signals which this microphone captures, calibration microphone signals which are associated with this microphone. Then, from the determined frequency spectra of the associated calibration microphone signals, a calibration-position-specific, frequency-dependent phase difference vector $\phi 0(f)$ is calculated. Then, in operating mode, the phase differences which are thus determined between the associated calibration microphone signals from their frequency spectra are used as calibration data to compensate for the corresponding phase disturbances and phase effects.

According to an embodiment, the calibration data are generated by the sequence of steps as listed in the flowchart shown in FIG. 3. First, in Step 310, a test signal, e.g. white noise, is played from the calibration position as the position of the expected desired signal source, and the corresponding calibration microphone signals are received by the microphones MIK1 and MIK2 by capturing the sound signals separately with the two microphones and generating the associated calibration microphone signals for this calibration position. Then, in Step 320, the Fourier transforms M1(f,T) and M2(f,T) of the calibration microphone signals at time T, and the real and imaginary parts Re1, Im1, Re2, Im2 of the Fourier transforms M1(f,T) and M2(f,T), are calculated, to calculate in turn, in Step 330, the frequency-dependent phases $\phi(f,T)$ at time T between the calibration microphone signals, according to the formula:

$$\phi(f,T)=\arctan((Re1*Im2-Im1*Re2)/(Re1*Re2+Im1*Im2))$$

In a subsequent step 340, the frequency-dependent phases $\phi(f,T)$ are averaged temporally over T to the calibration-position-specific, frequency-dependent phase difference vector $\phi 0(f)$, which contains the calibration data.

For determining the filter depending on a spatial angle, as is described below with reference to FIG. 4, optionally in Step 350 a calibration angle vector $\theta 0(f)=\arccos(\phi 0(f)c/2\pi fd)$ is calculated, after correction of the argument to the permitted value range [−1 . . . 1].

In determining the filter depending on a spatial angle, to generate an output signal s(t) in operating mode according to FIG. 4, first the current sound signal is received by the two microphones MIK1 and MIK2 in Step 410. In Step 420, in turn, the Fourier transforms M1(f,T) and M2(f,T) of the microphone signals 1 and 2 at time T, and their real and imaginary parts Re1, Im1, Re2, Im2, are calculated. Then, in Step 430, the frequency-dependent phases at time T $\phi(f,T)=\arctan((Re1*Im2-Im1*Re2)/(Re1*Re2+Im1*Im2))$ are calculated, and then in turn, in Step 440, a spatial angle vector $\theta(f)=\arccos(\phi(f)c/2\pi fd)$ is calculated for all frequencies f, including corresponding correction of the argument to the permitted value range [−1 . . . 1]. Then, in Step 450, the spectral filter function (which contains the attenuation values for each frequency fat time T, and is defined as follows: $F(f,T)=Z(\theta(f,T)-\theta_0(f))$, with a unimodal assignment function such as $Z(\theta)=((1+\cos\theta)/2)^n$, where n>0, is calculated depending on the calibration angle vector $\theta 0(f)$, the angle $\theta$ being defined so that $-\pi\leqq\theta\leqq\pi$. The value n represents a so-called width parameter, which defines the adjustable width of the directional cone. Then, in Step 460, the thus determined filter function F(f,T), with a value range $0\leqq F(f,T)\leqq 1$, is applied to a spectrum of the microphone signals 1 or 2 in the form of a multiplication: $S(f,T)=M1(f,T)F(f,T)$. From the thus filtered spectrum S(f,T), the output signal s(t) is then generated by inverse Fourier transformation, in Step 470. The above definition of the filter function F(f,T) should be understood as an example; other assignment functions with similar characteristics fulfill the same purpose. The soft transition chosen here between the extreme values of the filter function (zero and one) has a favorable effect on the quality of the output signal, in particular with respect to undesired artifacts of the signal processing.

According to a further embodiment of the invention, the determination of the spatial angle is omitted, and instead, during the calibration procedure, only the calibration-position-specific, frequency-dependent phase difference vector $\phi 0(f)$, which already contains the calibration information, is determined. Thus in this embodiment, in the determination of the calibration data, the calculation of the spatial angle vector $\theta_0(f)$, and thus the possibly necessary correction of the value range of the argument for the arccos calculation, are omitted from Step 350. During operating mode, the method includes the steps shown in FIG. 5. First, the current sound signal is again captured by the two microphones MIK1 and MIK2, in Step 510. From the microphone signals 1 and 2 which are generated from it, the current frequency spectra are determined by calculating the Fourier transforms M1(f,T) and M2(f,T) at time T, and their real and imaginary parts Re1, Im1, Re2, Im2, in Step 520. Then, in Step 530, the current frequency-dependent phase difference vector is calculated from their frequency spectra, according to $$\phi(f,T)=\arctan((Re1*Im2-Im1*Re2)/(Re1*Re2+Im1*Im2))$$

Now, in Step 540, the spectral filter function is calculated with respect to the calibration-position-specific, frequency-dependent phase difference vector ϕ0(f), according to the formula $$F(\phi(f,T))=(1-((\phi(f,T)-\phi0(f))c/2\pi fd)2)n,\text{where } n>0,$$

where c is the speed of sound, f is the frequency of the sound signal components, T is the time base of the spectrum generation, d is the distance between the two microphones, and n is the width parameter for the directional cone. On considering the formula, which as before must be understood as an example, it becomes clear that in the ideal case, i.e. in the case of phase equality between the phase difference vector currently measured in operating mode and the calibration-position-specific phase difference vector, the filter function becomes equal to one, so that the filter function applied to the signal spectrum S does not attenuate the signal to be output. With an increasing difference between current and calibration-position-specific phase difference vectors, the filter function approaches zero, resulting in respective attenuation of the signal to be output.

If in calibration mode multiple phase difference vectors were determined, e.g. for different calibration positions, it is possible to determine the filter function for one of these calibration positions and thus a desired position of the desired signal.

Then, in Step 550, the signal spectrum S of the calibrated signal is generated by applying the filter function F(f,T) to one of the microphone spectra M1 or M2, in the form of a multiplication according to the following formula (here for microphone spectrum M1):

$$S(f,T)=M1(f,T)F(f,T)$$

from which, in turn, in Step 560, the signal s(t) to be output is determined by inverse Fourier transformation of S(f,T).

According to a further embodiment of the invention, the method first works in operating mode, and the calibration-position-specific, frequency-dependent phase difference vector ϕ0(f) is set to ϕ0(f) equals zero for all frequencies f. This corresponds to a so-called "Broadview" geometry without calibration. If the device for processing sound signals is now to be calibrated, the device is switched to calibration mode. Assuming that now an appropriate desired signal is generated, e.g. simply by the designated user speaking, the calibration-position-specific, frequency-dependent phase difference vector ϕ0(f) is calculated. In this case, for example, the user speaks predefined test sentences, which are captured by the microphones and from which associated calibration microphone signals are generated. For example, the system or device, because of a command from outside, goes into calibration mode, in which it determines the ϕ0(f). For this purpose, the user speaks test sounds, e.g. "sh sh sh", until the system has collected sufficient calibration data, which can optionally be indicated by a LED, for example. The system then switches into operating mode, in which the calibration data are used.

It is then switched into operating mode, and the spectral filter function F is calculated for every current frequency-dependent phase difference vector depending on the previously determined calibration-position-specific, frequency-dependent phase difference vector. It is thus possible, for example, to deliver the device, e.g. a mobile telephone, initially with default settings, and then to do the calibration with the voice of the actual user in the operating environment the user prefers, e.g. including how the user holds the mobile telephone in relation to the user's mouth, etc.

According to a further embodiment of the invention, in operating mode with the previously calculated calibration-position-specific, frequency-dependent phase difference vector, the width parameter n is chosen to be smaller than in the uncalibrated operating state, in which the device is in default setting, compared with the initially taken operating mode. A width parameter which is smaller at first means a wider directional cone, so that at first sound signals from a larger directional cone tend to be less strongly attenuated. Only when the calibration has happened, the width parameter is chosen to be greater, because now the filter function is capable of attenuating sound signals arriving at the microphones correctly according to a smaller directional cone, even taking account of the (phase) disturbances which occur in the near field. The directional cone width, which is defined by the parameter n in the assignment function, is for example chosen to be smaller in operation with calibration data than in the uncalibrated case. Because of the calibration, the position of the signal source is known very precisely, so that then it is possible to work with "sharper" beam forming and therefore with a narrower directional cone than in the uncalibrated case, where the position of the source is known approximately at best.

According to a further embodiment of the invention, in calibration mode, additionally, the calibration position is varied in a spatial and/or state range in which the user is expected in operating mode. Then the calibration-position-specific, frequency-dependent phase difference vector ϕ0(f) is calculated for these varied calibration positions. In this way, in addition to different spatial positions, other effects, e.g. caused by an open side window of a motor vehicle, can be taken into account in the calibration, since not only the user's position, e.g. the sitting position of the driver of the motor vehicle, but also the ambient state, e.g. whether the side window is open or closed, are taken into account.

Variations which occur during operation can in principle not be handled by a single calibration. For this, according to a further embodiment of the invention, an adaptive method, which instead of calibration signals evaluates the actual desired signals during operation, is used. According to such an embodiment, "adaptive post-calibration" is done only in such situations in which, apart from the desired signal, the microphones receive no other interfering noise signals.

According to a further embodiment of the invention, in this way a calibration mode is even omitted completely, and taking account of phase effects is left completely to the adaptive method. According to one embodiment, therefore, the method is in the form of an adaptive method, which switches immediately into operating mode. The calibration-position-specific, frequency-dependent phase difference vector ϕ0(f) is initially either set to ϕ0(f) equals zero for all frequencies f, or for example stored values from earlier calibration or operating modes are used for all frequencies of the calibration-position-specific, frequency-dependent phase difference vector ϕ0(f). Alternatively, after passing through calibration mode initially, a switch into operating mode takes place to calculate the current calibration-position-specific, frequency-dependent phase difference vector ϕ0(f). In further operation, the calibration-position-specific, frequency-dependent phase difference vector $\phi 0(f)$ is then updated by the adaptive method, the current sound signals of a sound source being interpreted in operating mode as sound signals of the selected calibration position and used for calibration. Thus updating, unnoticed by the user, of the calibration data is applied, the updating taking place whenever it is assumed that the current sound signals are desired signals in the meaning of the relevant application and/or the current configuration of the device and are not affected by interfering noise, so that from these sound signals, the calibration-position-specific, frequency-dependent phase difference vector $\phi 0(f)$ is then determined. Switching between calibration and operating mode otherwise under control of the device, can thus be omitted. Instead, the calibration takes place "subliminally" during operation, whenever the signal quality allows. A criterion for the signal quality can be, for example, the signal-to-noise ratio of the microphone signals.

However, the effect on the signal to be output of a window being opened during operation can still be compensated for in this way only insufficiently or not at all, since the condition of freedom from interfering noise when the sound signals are captured to determine the calibration data can hardly be achieved in this case. To make the adaptation resistant to interfering noise, according to a further embodiment of the invention, therefore, an also concurrent, phase-sensitive noise model, using which the interference signals for the adaptation process are calculated out of the microphone signals before the actual compensation for the phase effects is done, is provided. According to an embodiment, therefore, the method further includes interference signals first being calculated out of the microphone signals of the current sound signals in operating mode using a concurrent, phase-sensitive noise model, before the calibration-position-specific, frequency-dependent phase difference vector $\phi 0(f)$ is updated.

According to a further embodiment of the invention, the step of defining at least one calibration position further includes arranging a test signal source in the calibration position or near it, the sound signal source sending a calibrated test signal, both microphones capturing the test signal, and generating the associated calibration microphone signals from the test signal only. Up to now it has been assumed that the phase angle $\phi 0$ is spectrally resolved, i.e. frequency-dependent, and the corresponding vector $\phi 0(f)$ is determined during the calibration procedure based on the received test signals, whereas the width-determining parameter n is scalar, i.e. the same for all frequencies. If a half-value phase difference $\phi ½(f)$, in which the filter function $F(\phi(f,T))$ has fallen to the value ½, is defined, the width parameter n is linked to $\phi ½(f)$, given the above definition of the filter function $F(\phi(f,T))$, as follows:

$$n=-1/\log 2(1-(c\phi ½(f)/2\pi fd)2),$$

where $\phi ½(f)$ is a parameter vector, which is initially specified for each frequency f.

For an extended calibration procedure, now the source of the test signals, e.g. a so-called artificial mouth, is no longer positioned only at the location of the expected desired signal source, but varied over a spatial range in which, in normal operation, the position of the desired signal source can also be expected to vary. For example, in a motor vehicle application, the breadth of variation caused by natural head movements, variable seat adjustments and different body sizes of a driver should be covered. For each measurement with different locations of the test signal source, a vector $\phi 0(f)$ is now determined as described above. Then, from these measurements for each frequency, the arithmetic means $\mu(f)$ and standard deviations $\sigma(f)$ are calculated for each frequency f over the calculated calibration-position-specific, frequency-dependent phase difference vector $\phi 0(f)$. Here it should be noted that the means $\mu(f)$ are arithmetic means of variables which have previously been averaged over time; $\mu(f)$ is now used instead of $\phi 0(f)$. The previously scalar parameter n is now also made frequency-dependent and determined by the calibration. For this purpose, the half-value phase difference $\phi ½(f)$ is linked via a constant k to the standard deviation: $\phi ½(f)=k\sigma(f)$. Now, if a Gaussian distribution is assumed for the measured values $\phi 0(f)$, which is not necessarily the case, but for lack of better knowledge is assumed according to the method, 95% of all measurement results would be within the range $\pm\phi ½(f)$, if k=2 is chosen. For the width-determining parameter n(f), the following then applies:

$$n(f)=-1/\log 2(1-(c\sigma(f)/\pi fd)2).$$

This extension of the calibration process allows for the fact that not only the angle of incidence and phase angle are changed by reflections in a frequency-dependent manner, but also the level of this change can be frequency-dependent, which according to the method can be compensated for by a spectrally resolved "beam width".

It should also be mentioned that all described devices, methods and method components are of course not restricted to use in a motor vehicle, for example. For example, a mobile telephone or any other (speech) signal processing device which uses a microphone array technology can be calibrated in the same way.

The method and device according to the invention can be usefully implemented using, or in the form of, a signal processing system, e.g., with a digital signal processor (DSP system), or as a computer program or a software component of a computer program, which for example runs on any computer PC or DSP system or any other hardware platform providing one or more processors to execute the computer program. The computer program may be stored on a computer program product comprising a physical computer readable storage medium containing computer executable program code (e.g., a set of instructions) for phase-sensitive processing of sound signals of at least one sound source, wherein the computer program comprising several code portions is executable by at least one processor, CPU or the like. Moreover, a computer-readable storage medium may be provided for storing computer executable code for phase-sensitive processing of sound signals of at least one sound source, wherein the computer executable code may include the computer program for phase-sensitive processing of sound signals of at least one sound source in computer executable form.

Reference Symbol List:

MIK1, MIK2 microphones at a fixed distance;

M1(f,T), M2(f,T) Fourier transforms of the microphone signals;

d distance between microphones MIK1 and MIK2;

f frequency;

T time of determination of a spectrum or output signal;

$\phi 0(f)$ frequency-dependent phase difference vector in calibration mode, averaged over time;

$\phi(f,T)$ frequency-dependent phase difference vector of the microphone signals during operation;

Re1(f), Im1(f) real and imaginary parts of the spectral components of the first hands-free microphone signal (microphone 1);

Re2(f), Im2(f) real and imaginary parts of the spectral components of the second hands-free microphone signal (microphone 2);

$\theta_0(f)$ frequency-dependent angle of incidence of the first test audio signal in calibration mode, averaged over time;

$\theta(f,T)$ frequency-dependent angle of incidence of the microphone signals during operation;

$\mu(f)$ arithmetic mean values of $\phi 0(f)$ for each frequency f;

$\sigma(f)$ standard deviations of $\phi 0(f)$ for each frequency f;

n width parameter;

n(f) frequency-dependent width parameter, with $\phi 1/2(f)=k\sigma(f)$, where $\phi 1/2(f)$ is the frequency-dependent phase difference at which the filter function F at frequency f takes the value ½;

F(f,T) filter function;

Z unimodal assignment function;

S(f,T) signal spectrum of signal to be output;

s(t) signal to be output.

The invention claimed is:

1. A method comprising:

determining, by a device, a current, frequency-dependent phase difference vector between current microphone signals from a frequency spectra of the current microphone signals, the current microphone signals being captured by a first microphone and a second microphone, and the first microphone being positioned a particular distance from the second microphone;

selecting, by the device, a calibration position;

determining, by the device, a spectral filter function for each of the first microphone and the second microphone, the spectral filter function being determined for each of the first microphone and the second microphone based on the current, frequency-dependent phase difference vector and a respective calibration-position-specific, frequency-dependent phase difference vector of the selected calibration position;

generating, by the device, a signal spectrum of a signal to be output by multiplication of at least one of the frequency spectra of the current microphone signals with the spectral filter function of the respective selected calibration position, the spectral filter function being chosen so that a value of an absolute value of a difference between a current phase difference and a calibration-position-specific phase difference for a corresponding frequency is directly proportional to an attenuation of spectral components of sound signals; and obtaining, by the device, the signal to be output for the respective selected calibration position by inverse transformation of the generated signal spectrum.

2. The method of claim 1, where determining the spectral filter function includes:

calculating, at a time T, the spectral filter function based on a speed of sound and the particular distance the first microphone is positioned from the second microphone.

3. The method of claim 1, where generating the signal spectrum includes:

applying the spectral filter function to a microphone spectrum to generate the signal spectrum.

4. The method of claim 3, where applying the spectral filter function to the microphone spectrum includes:

multiplying the filter function with the microphone spectrum to generate the signal spectrum.

5. The method of claim 1, where obtaining the signal to be output includes:

generating the signal to be output for the respective selected calibration position by inverse Fourier transformation of the generated spectrum signal.

6. The method of claim 1, further comprising:

calculating Fourier transforms M1(f,T) and M2(f,T) of calibration microphone signals at a time T, the calibration-position-specific, frequency-dependent phase difference vector being determined based on the calculated Fourier transforms of the calibration microphone signals at the time T.

7. The method of claim 6, further comprising:

calculating real parts Re1, Re2 and imaginary parts Im1, Im2 of the Fourier transforms M1(f,T) and M2(f,T);

calculating calibration frequency-dependent phases at the time T between the calibration microphone signals; and averaging the calculated calibration frequency-dependent phases temporally over the time T to determine the calibration-position-specific, frequency-dependent phase difference vector.

8. A non-transitory computer-readable medium storing instructions, the instructions comprising:

one or more instructions that, when executed by a processor, cause the processor to:

determine a current, frequency-dependent phase difference vector between current microphone signals from a frequency spectra of the current microphone signals, the current microphone signals being captured by a first microphone and a second microphone, and the first microphone being positioned a particular distance from the second microphone, select a calibration position, determine a spectral filter function for each of the first microphone and the second microphone, the spectral filter function being determined for each of the first microphone and the second microphone based on the current, frequency-dependent phase difference vector and a respective calibration-position-specific, frequency-dependent phase difference vector of the selected calibration position, generate a signal spectrum of a signal to be output by multiplication of at least one of the frequency spectra of the current microphone signals with the spectral filter function of the respective selected calibration position, the spectral filter function being chosen so that a value of an absolute value of a difference between a current phase difference and a calibration-position-specific phase difference for a corresponding frequency is directly proportional to an attenuation of spectral components of sound signals, and obtain the signal to be output for the respective selected calibration position by inverse transformation of the generated signal spectrum.

9. The non-transitory computer-readable medium of claim 8, where the one or more instructions to determine the spectral filter function include:

one or more instructions to calculate the spectral filter function based on a speed of sound and the particular distance the first microphone is positioned from the second microphone.

10. The non-transitory computer-readable medium of claim 8, where the one or more instructions to generate the signal spectrum include:

one or more instructions to apply the spectral filter function to a microphone spectrum to generate the signal spectrum.

11. The non-transitory computer-readable medium of claim 10, where the one or more instructions to apply the spectral filter function to the microphone spectrum include:

one or more instructions to multiply the filter function with the microphone spectrum to generate the signal spectrum.

12. The non-transitory computer-readable medium of claim 8, where the one or more instructions to obtain the signal to be output include:

one or more instructions to generate the signal to be output for the respective selected calibration position based on an inverse Fourier transformation of the generated spectrum signal.

13. The non-transitory computer-readable medium of claim 8, where the instructions further comprise:

one or more instructions to calculate Fourier transforms M1(f,T) and M2(f,T) of calibration microphone signals at a time T, the calibration-position-specific, frequency-dependent phase difference vector being determined based on the calculated Fourier transforms of the calibration microphone signals at the time T.

14. The non-transitory computer-readable medium of claim 13, where the instructions further comprise:

one or more instructions to calculate real parts Re1, Re2 and imaginary parts Im1, Im2 of the Fourier transforms M1(f,T) and M2(f,T);

one or more instructions to calculate calibration frequency-dependent phases at the time T between the calibration microphone signals; and one or more instructions to calculate an average of the calculated calibration frequency-dependent phases temporally over the time T to determine the calibration-position-specific, frequency-dependent phase difference vector.

15. A system comprising:

one or more processors to:

determine a current, frequency-dependent phase difference vector between current microphone signals from a frequency spectra of the current microphone signals, the current microphone signals being captured by a first microphone and a second microphone, and the first microphone being positioned a particular distance from the second microphone, select a calibration position, determine a spectral filter function for each of the first microphone and the second microphone, the spectral filter function being determined for each of the first microphone and the second microphone based on the current, frequency-dependent phase difference vector and a respective calibration-position-specific, frequency-dependent phase difference vector of the selected calibration position, generate a signal spectrum of a signal to be output by multiplication of at least one of the frequency spectra of the current microphone signals with the spectral filter function of the respective selected calibration position, the spectral filter function being chosen so that a value of an absolute value of a difference between a current phase difference and a calibration-position-specific phase difference for a corresponding frequency is directly proportional to an attenuation of spectral components of sound signals, and obtain the signal to be output for the respective selected calibration position by inverse transformation of the generated signal spectrum.

16. The system of claim 15, where, when determining the spectral filter function, the one or more processors are to:

calculate the spectral filter function based on a speed of sound and the particular distance the first microphone is positioned from the second microphone.

17. The system of claim 15, where, when generating the signal spectrum, the one or more processors are to:

apply the spectral filter function to a microphone spectrum to generate the signal spectrum.

18. The system of claim 17, where, when applying the spectral filter function to the microphone spectrum, the one or more processors are to:

multiply the filter function with the microphone spectrum to generate the signal spectrum.

19. The system of claim 17, where, when obtaining the signal to be output, the one or more processors are to:

generate the signal to be output for the respective selected calibration position based on an inverse Fourier transformation of the generated spectrum signal.

20. The system of claim 15, where the one or more processors are further to:

calculate Fourier transforms M1(f,T) and M2(f,T) of calibration microphone signals at a time T;

calculate real parts Re1, Re2 and imaginary parts Im1, Im2 of the Fourier transforms M1(f,T) and M2(f,T);

calculate calibration frequency-dependent phases at the time T between the calibration microphone signals; and calculate an average of the calculated calibration frequency-dependent phases temporally over the time T to determine the calibration-position-specific, frequency-dependent phase difference vector.

* * * * *